United States Patent [19]

Takahari et al.

[11] 4,026,737

[45] May 31, 1977

[54] METHOD FOR COLORING A STAINLESS STEEL

[75] Inventors: Tomoo Takahari; Shiyuichi Kondo; Nobumasa Sone; Kengi Hashimoto; Tadashi Ishiguro, all of Hikari, Japan

[73] Assignee: Nippon Steel Corporation, Tokyo, Japan

[22] Filed: Oct. 17, 1975

[21] Appl. No.: 623,322

[30] Foreign Application Priority Data

| | | |
|---|---|---|
| Oct. 22, 1974 | Japan | 49-121016 |
| Oct. 23, 1974 | Japan | 49-121325 |
| Apr. 17, 1975 | Japan | 50-45829 |

[52] U.S. Cl. ..... 148/6.14 R; 148/6.2; 148/6.21

[51] Int. Cl.[2] ..... C23F 5/02; C23F 7/00

[58] Field of Search ..... 148/6.2, 6.21, 6.14 R; 204/56 R, 1 T

[56] References Cited

UNITED STATES PATENTS

| | | | |
|---|---|---|---|
| 2,576,680 | 11/1951 | Guitton | 148/6.14 R |
| 3,210,220 | 10/1965 | Clegg | 148/6.2 X |
| 3,804,730 | 4/1974 | Evans | 204/56 R |
| 3,839,096 | 10/1974 | Skedgell et al. | 148/6.2 |

*Primary Examiner*—Ralph S. Kendall
*Attorney, Agent, or Firm*—Toren, McGeady and Stanger

[57] ABSTRACT

A method for coloring a stainless steel using a potential-time curve which comprises seeking for an individual coloring potential difference to be colored by compensating a standard coloring potential difference by difference between a standard inflexion point potential and an individual inflexion point potential, and stopping the coloring when the individual coloring potential changes in an amount corresponding to the individual coloring potential difference from the individual inflexion point potential.

15 Claims, 11 Drawing Figures

A: Surfacial Film Produced During Production of Stainless Steel Sheet

B: Denaturallized Layer (Part of Base Steel)

C: Base Steel (Saturated Calomel Electrode)

Curve 2 : Coloring of Standard Material
" 1 : A'-B' < A-B (Noble)
" 3 : A''-B'' > A-B (Base)

METHOD FOR COLORING A STAINLESS STEEL

BACKGROUND OF THE INVENTION

In recent years rapid progress has been made in the field of stainless steel coloring techniques and various patent specifications have been laid open.

Among the prior publications, Japanese patent laid-open specifications Sho 46-7308, Sho 48-11243 and Sho 49-21339 disclose an epoch-making method for coloring a stainless steel by which better wear resistance and reproducibility can be attained as compared with the conventional art and since the development of this method, colored stainless steels have been commercialized and colored stainless steels are now being produced on a larger scale then previously.

Japanese patent laid-open specification Sho 48-11243 describes, in detail the reproductivity of coloring of a stainless steel.

According to the above Japanese patent laid-open specification, when a stainless steel is immersed in a solution containing chromic and sulphuric acids, the potential between the surface of the stainless steel and a reference electrode varies as shown by the potential-time curves in FIG. 1 and FIG. 2, and the potential variation rate in respect to time shows its lowest value just before a film which assures coloring is formed on the stainless steel surface, while the potential shows its minimum value in case of a saturated calomel electrode (FIG. 1) and its maximum value in case of a platinum electrode (FIG. 2). These potential values are called as "an inflexion point potential (A)", after which the coloring starts, and as the coloring progresses as blue-gold red-green, the potential raises or lowers as shown in FIG. 1 or FIG. 2. Now taking the potential at which a desired color is produced as the coloring potential (B), the potential difference (A − B) between the inflexion point potential (A) and the coloring potential (B) takes a constant value in case of a given combination of the steel material to be colored and the coloring solution. Therefore, this prior art aims to obtain a single color constantly by predetermined the potential difference (A − B) for a desired color and by stopping the coloring when a potential difference (A′ − B′) shows a value equal to the predetermined difference (A − B).

However, the present inventors have conducted experiments in which the present inventors have conducted experiments in which about a dozen of stainless steel grades were colored according to the method of the above Japanese patent by immersing SUS 304 stainless steel sheets of BA (bright annealing) finish (surface finish as specified by JIS G 4305) in an aqueous solution containing 300 g/l of chromic anhydride and 500 g/l of sulfuric acid at 75° C and maintaining the potential difference between the inflexion point potential and the coloring potential constant at 13 mv (standard potential for red coloring), but the results have revealed that the obtained colored films vary in many color tones ranging gold, red, purple, dark blue, and then intermediate colors as shown in FIG. 4. Thus constant reproductivity of a colored film on a stainless steel can not be attained by the method disclosed by Japanese patent laid-open specification Sho 48-11243.

Further, the prior art for coloring a stainless steel has defects that when stainless steel lots having different production histories, such as, production lot and time are subjected to coloring treatments under the same conditions, different colored films are formed depending on the production histories or in worse cases only dull colors can be obtained.

The present inventors have tried to color stainless steel lots having different production histories according to the disclosure of Japanese patent laid-open specification Sho 48-11243 and have found that the color variation is considerable particularly in the blue and gold colors, meanwhile the variation is not so large in red and green colors which require a long time period of immersion. Thus it can be concluded that the surface condition of the steel sheets varies depending on their production history.

Still further, the prior art for coloring a stainless steel has the defect that an attractive color can be developed when the method is applied to nickel-chromium stainless steels, but the attractive color cannot be obtained, the obtained color is limited to brown or dark brown only and a desired color is not obtained when the method is applied to chromium-straight stainless steels. Therefore, up to now, only costly nickel-chromium stainless steels, such as, SUS 304 have been limitedly used for coloring, and this fact has users to be of the opinion that a colored stainless steel is a highly costly material, and application of a colored stainless steel has been greatly limited.

SUMMARY OF THE INVENTION

Therefore, one of the objects of the present invention is to provide a method for coloring a stainless steel which can overcome the above defects of the prior art and can eliminate the color variation caused by difference in conditions of the steel materials to be colored by controlling the potential differences in the coloring solution so as to attain good reproductivity of a desired color.

Another object of the present invention is to provide a method for coloring a stainless steel which can eliminate nonuniformity of color and color variation caused by differences in the production history and bad surface conditions of the stainless steel to be colored so as to consistently obtain the desired color.

Still another object of the present invention is to provide a method which can produce a discrete color on a chromium-straight stainless steel which has been impossible to color by the prior art.

The present inventors have conducted various extensive experiments to find conditions for obtaining good reproductivity of a desired color, and have found that variation in the inflexion point potential as scanned on the potential-time curve has a great influence on the variation in colors obtained, and that if the potential difference is not controlled it is not possible to prevent the color variation.

But, the present inventors have found that it is impossible to eliminate the variation in the inflexion point potential completely even if the coloring conditions, such as the surface condition of the material to be colored, the composition of the coloring solution and the temperature, are controlled.

Then the present inventors have found that it is possible to obtain a desired color without color variation when the coloring potential difference of a standard material is compensated by the amount of the variation of the infexion potential and this compensated value is used as a coloring potential difference for obtaining a desired color instead of controlling the variation of the inflexion point potential, and this fact has been formulated.

The present invention will be described in details referring to the attached drawings.

Thus, the present invention is based on the control system formulated above.

For determining the compensation coefficient for the inflexion point potential, the present inventors have made various experiments repeatedly as follows.

SUS 304 stainless steel sheets of BA finish as standard material were immersed in an aqueous solution containing 300 g/l of chromic anhydride and 500 g/l of sulfuric acid at 75° C, using a saturated calomel electrode on a platinum electrode with the coloring potential difference between the inflexion point potential and the coloring potential of the desired color.

Figure 3:
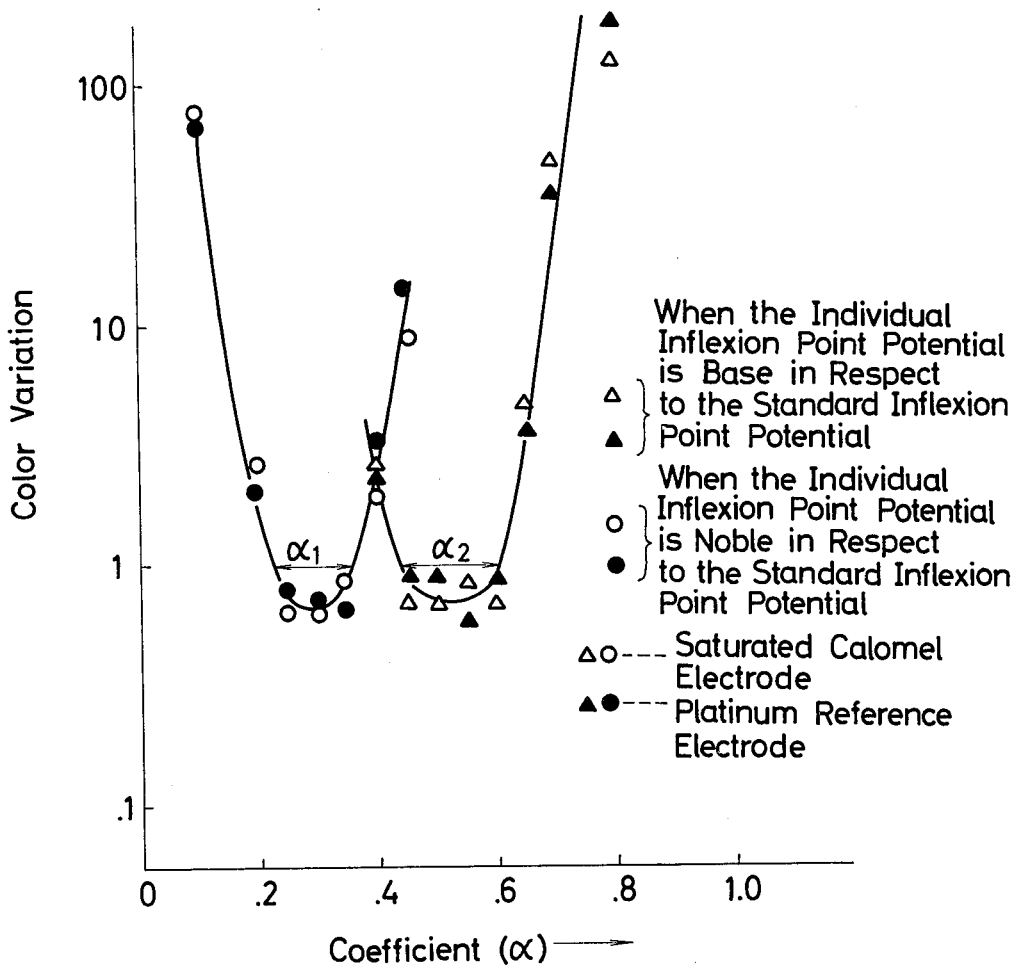
FIG. 3 is a graph showing relation between color variation and coefficient ($\alpha$).
Figure 4:
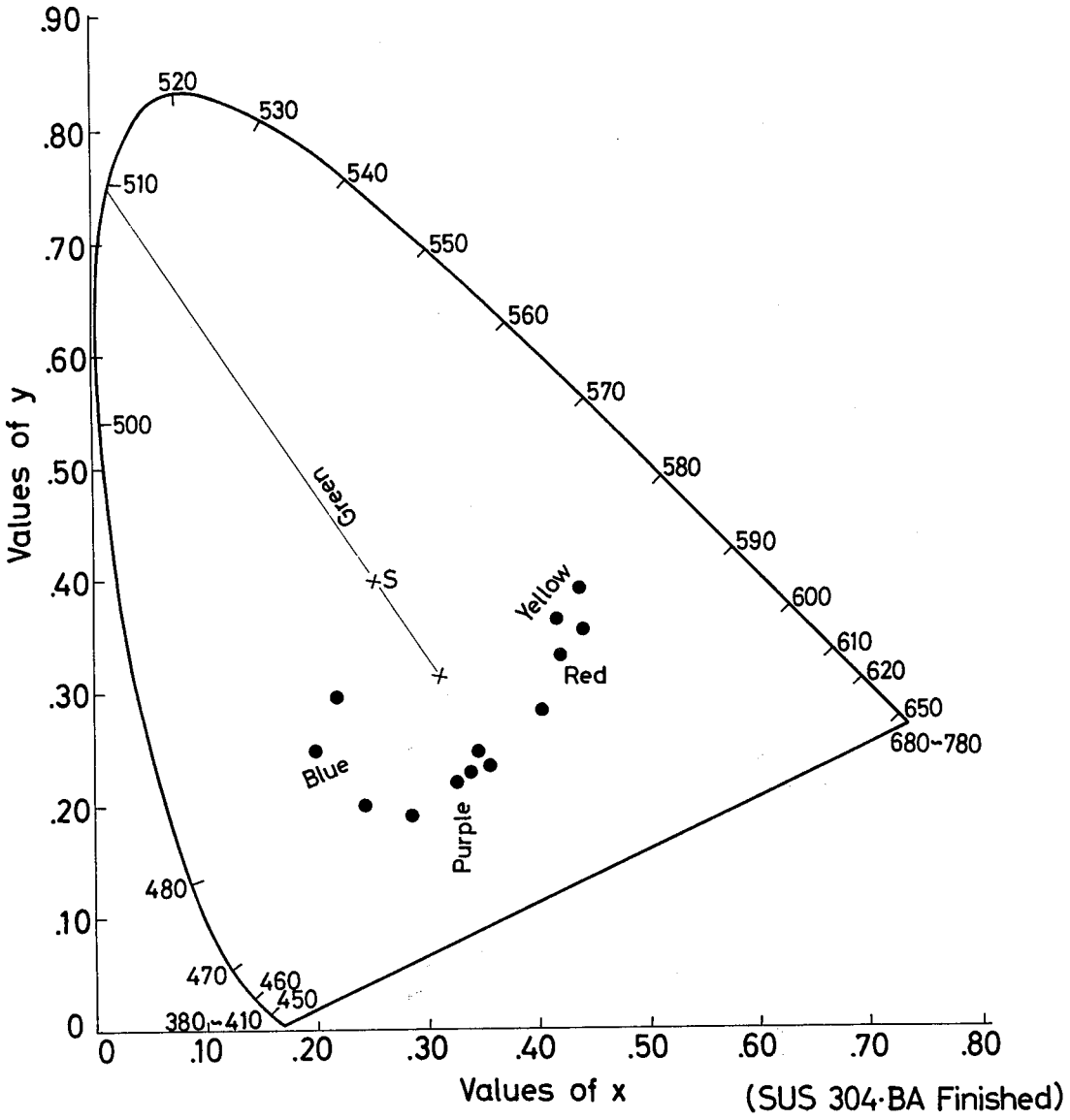
FIG. 4 is a graph showing color measurements of colored steels according to the conventional art.

Then this potential difference was used as a standard value, and the coloring potential difference of subsequent coloring treatments was sought for by varying the coefficient ($\alpha$) in the following formula (1). In FIG. 3, it was shown that the relation between the compensation coefficient $\alpha$ and the color differences which were between the colors thus obtained and the color obtained with coloring potential difference of standard material were sought for. In FIG. 3, $\alpha_1$ means that the individual inflexion point potential was noble and $\alpha_2$ means that the potential was base in respect to the standard potentials.

In FIG. 3, since a color variation within 1.0 is viewed as a color having no variation by a naked eye, the compensation coefficient range for colors without variation is:

$$0.23 \leq \alpha_1 \leq 0.36$$
$$0.44 \leq \alpha_2 \leq 0.61$$

Therefore, when the inflexion point potential of a material to be colored according to the present invention is (A′) while the coloring potential is (B′), the coloring potential difference (A′−B′) of the material to be colored is given by the following formula, and by completing the coloring treatment when the potential difference reaches the difference (A′−B′), it is possible to eliminate the color deviation and assure the reproductivity of a desired color.

Individual coloring potential difference (A′−B′) =Standard coloring potential difference (A−B)±$\alpha$ (standard inflexion point potential (A) — individual inflexion point potential (A′)) (1)

in which (A′−B′) is the potential difference between the inflexion point potential (A′) and the coloring potential of an individual material, (A−B) is the potential difference between the inflexion point potential (A) and the coloring potential (B) of a standard material;

(A′) is an inflexion point potential of an individual material;

(A) is an inflexion point potential of a standard material;

(B′) is a potential at which the coloring of an individual material is stopped;

(B) is a potential corresponding to a potential for a desired color on a standard material;

(±) varies depending on the kind of the reference electrode at the measurement of potentials, and in case of a saturated calomel electrode it is (±), and in case of a platinum electrode it is (−);

coefficient $\alpha$: when the individual inflexion point potential is nobler than the standard inflexion point potential, $\alpha_1$ is used, and when the individual inflexion point potential is base than the standard inflexion point potential, $\alpha_2$ is used.

$\alpha_1$ : 0.23 –0.36

$\alpha_2$ : 0.44 – 0.61

Figure 1:
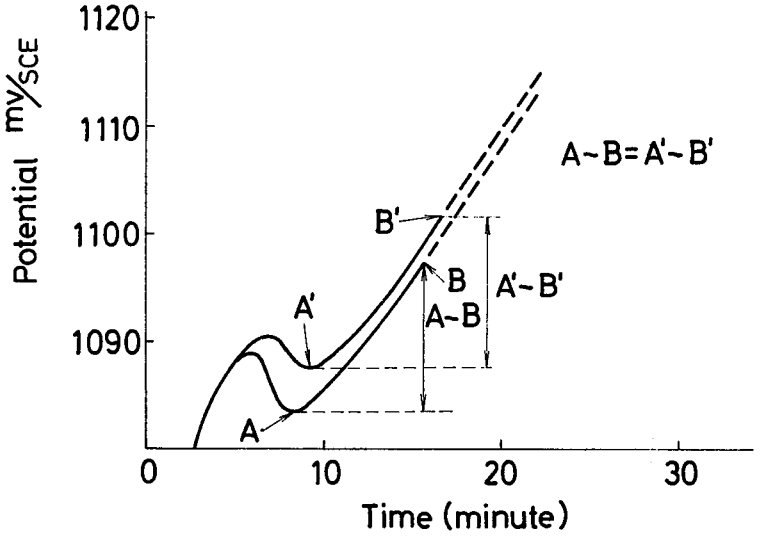
FIG. 1 is a graph showing potential-time curves obtained when a saturated calomel electrode is used.
Figure 2:
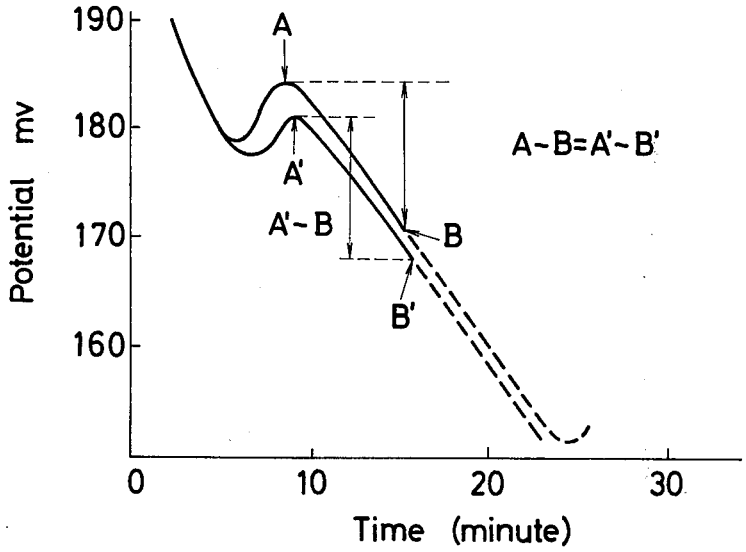
FIG. 2 is a graph showing potential-time curves obtained when a platinum electrode is used.
Figure 9:
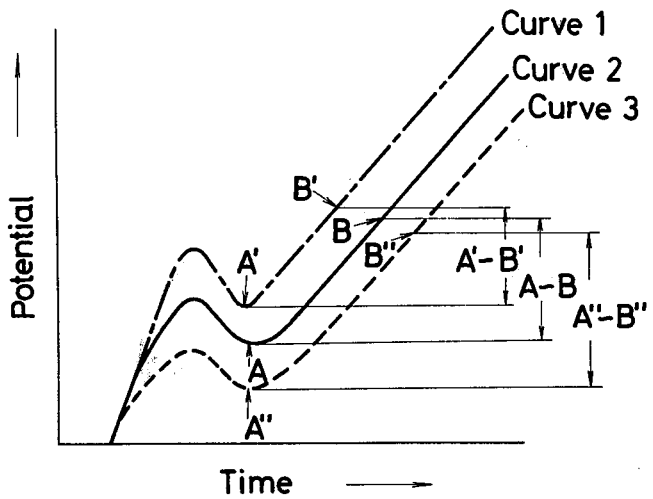
FIG. 9 is a graph showing the relation between the potential and the coloring-time when a saturated calomel electrode is used.

The above control system may be illustrated in FIG. 9. In the conventional art the coloring potential difference is fixed as A′−B′=A−B so that good reproductivity of a desired color can not be obtained, whereas according to the present invention, the standard coloring potential difference (A−B) is compensated as shown in FIG. 9, in which (A′ − B′) is smaller than (A − B) in the curve 1 and (A′ − B′) is larger than (A − B) in the curve 2, so that good reproductivity of a desired color without variation can be assured. The method of the present invention can be applied advantageously to all stainless steels including austenite stainless steels and ferrite stainless steels of various surface finishes such as BA finish and HL finish, and can be performed in any coloring solution, such as chromic acid solutions containing acid, and alkali solutions, which the potential-time curve shows as behavior as shown in FIG. 1 and FIG. 2, namely in any solution which produces a colored film.

As for the reference electrode, any conventional reference electrode can be used with a bridge which is stable when connected to a coloring solution such as, a mercury-mercury sulfate — 5 mol sulfuric acid solution. However, for simplification of the operation, it is desirable to use a platinum sheet as the reference electrode. Also titanium and lead electrodes may be used as the reference electrodes, but these are not so desirable.

As mentioned hereinbefore, stainless steel lots having different production histories cause delicate problems and some are not suitable for coloring, but it is impossible to detect the difference of the production history beforehand, and the difference or color defects caused thereby can be detected only after the coloring treatment.

Therefore, it is necessary to maintain the same surface condition of the stainless steels prior to the coloring treatment.

Thus, the present inventors have tried to obtain a homogeneous surface condition of the stainless steel sheets by various pretreatments.

A degreasing step is generally performed before immersion in the coloring solution. The present inventors have tried an electrolytic cleaning in an alkali solution for the purpose of improving the surface condition, but the results were not satisfactory.

Then trials have been made for the same purpose by immersion in a hydrochloric acid solution which is used as a pretreatment for the coloring of stainless steels according to the prior art (Japanese patent publication Sho 39-29952). In this case the surface of the stainless steel thus pretreated show a white turbidness, which has an adverse effect on the colors after the coloring treatment.

Further, the present inventors have tried the following treatments (I) - (III) which are conventionally used as pretreatments for the plating of stainless steels.

(I) Immersion in 10 – 30% HCl solution at room temperature and then cathodic treatment.

(II) Immersion in 20 – 50% $H_2SO_4$ solution between 65 and 85° C until generation of gas bubble.

(III) Immersion in HCl—$H_2SO_4$ solution at room temperature until generation of bubbles by gases.

Any of the above three immersion treatments has been found to have no effect on eliminating the differences in the production history of stainless steels.

Reviewing the causes attributable to the failure, all of the above immersion treatments have as their object to dissolve effectively only the surfacial film, such as, an oxide film and a passivated film formed on the steel surface during its production stage, and active the steel surface. The present inventors have found that the dissolution of the surfacial film as attained by these treatments is not a satisfactory pretreatment for the coloring of stainless steels.

Figure 7:
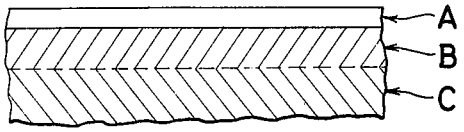
FIG. 7 shows the surface structure of a stainless steel sheet.

Explanations will be made referring to FIG. 7 showing the model of the surface structure of a BA finished stainless steel. In the figure, A is a surfacial film of the spinel type oxide formed during production of the stainless steel sheet, and B is an intermediate layer which is produced by denaturalization of a part of the matrix during the production stage, and C is the matrix that is not denaturalized. The thickness of A and B may be affected by the thickness of the steel sheet, and as the steel sheet thickness increases, the thickness of A and B respectively increases. According to the estimates by the present inventors, the thickness of the A layer is about several tens A to several hundreds A, while the thickness of the B layer is about several hundreds A to several thousands A.

In the surface structure as shown in FIG. 7, the conventional pretreatments can remove only the A layer so that the difference in the production history is retained as the difference in the B layer, and produces a considerable effect on the colored film so be formed on the stainless steel, thus causing color variation.

In order to eliminate the difference in the production history, it has been conceived by the present inventors to completely dissolve both the A and B layers until the matrix C appears.

Then, the present inventors conducted various immersion and electrolytic treatments using acid solution for the purpose of removing both the A surfacial layer A and the denaturalized layer B without decreasing the luster, and have confirmed the above concept on which the present invention is based.

As understood from the above description, the present invention aims to remove the surface until the matrix appears so as to eliminate difference in the surface condition caused by the difference in the production history of individual stainless steels, and thus the present invention is basically different from the pretreatment disclosed in Japanese patent publication Sho 49-16178 which aims to decreasing or activation of the steel surface, and has great advantages for commercial production of colored stainless steels.

For the removal of the surfacial layer, an acid solution treatment is desirable. As for the acid solution, sulfuric acid solution, phosphoric acid solution, nitric acid solution, chromic acid solution, their mixture with or without hydrochloric acid may be used. The treatment may be made by immersion in the acid solution or by electrolysis. The treatment conditions for assuring the reproductivity of a desired color without color variation in spite of differences in the production history of the steel material to be colored vary depending on the surface condition of the steel material. However, preferable treatment conditions are as below.

A current density ranging from 0.5 to 30 A/dm$^2$ is desirable in the case of the electrolytic treatment. Current densities more than 30 A/dm$^2$ cause vigorous generation of hydrogen and dissolve the steel substrate so that undesirable color variations along the vertical stripe are formed on the colored stainless steel product, while current densities less than 0.5 A/dm$^2$ require a long time of treatment. In case the of the immersion treatment, a 30 to 1200 second treatment time is advantageous. As for the treatment temperature, satisfactory results can be obtained at room temperature, but it is advantageous to heat the treatment solution to a temperature between 40° and 60° C for saving the treatment time.

The pretreatment mentioned above is desirably performed between the degreasing step and the coloring step, and when the pretreatment is performed simultaneously with the degreasing step uniformity of color is not obtained.

The present inventors have found through various experiments that in the case of coloring of chromium-straight stainless steels, satisfactory attractive colors can not be obtained even by the pretreatment and coloring treatment as described hereinbefore.

Then the present inventors have conducted extensive experiments for the purpose of developing a coloring method for chromium-straight steels, and have completed a method which can produce discrete various color including, blue, gold, red, purple, etc. continuously with good reproductivity.

According to this method, a precoloring treatment as described hereinafter is applied before the coloring treatment.

Figure 8:
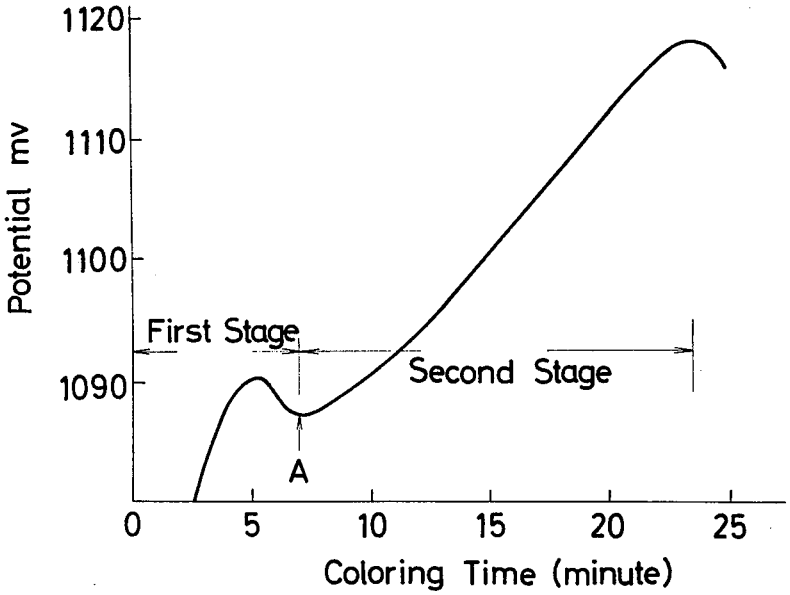
FIG. 8 is a graph showing the relation between the potential and the coloring-time.

The potential-time curve in FIG. 8 shows formation of a colored film on a steel material when immersed in a conventional coloring bath ($CrO_3$—$H_2SO_4$). The present inventors have studied the formation reaction is completed in two steps.
completed in two steps.

The first step reaction ranges from the immersion in the bath to the inflexion point potential A and takes about 7 minutes. During the first stage reaction, almost no dissolution of the steel substrate takes place and a very thin film (base film) which provide basis for a colored film grows slowly. This base film takes a light gray color tone and is considered to have a different composition from that of a colored film which is formed in the second stage. The second step reaction ranges from the inflexion point potential A and thereafter, in which dissolution of the steel substrate takes place and the colored film grows along with the substrate dissolution. In the second stage, although nickel-chromium stainless steels are given discrete colors, chromium-straight stainless steels are not. It has been postulated by the present inventors that in the case of chromium-straight stainless steels, the corrosive medium is so vigorous that the base film suitable for coloring is hardly formed. Therefore, the present inventors have conceived that if and when a base film is allowed to grow in a coloring bath suitable for chromium-straight stainless steels in the first stage, discrete colors can be obtained. On the basis of this conception, the present inventors studied various experiments to find coloring baths suitable for chromium-straight stainless steels, and have found that desired colors including blue, gold, red, purple, green, etc. can be provided on chromium-straight stainless steels by immersion of electrolysis in a precoloring treatment solution containing at least compound one selected from the group consisting of sulfuric acid, nitric acid and phosphoric acid together with at least one compound selected from the group consisting of chromic anhydride, potassium dichromate, sodium dichromate, or together with at least one material selected from the group consisting of iron salts, nickel salts and manganese salts, and then by coloring in a conventional aqueous solution containing chromic acid and sulfuric acid. It has been confirmed that chromium-nickel stainless steels can be colored too by the above method.

DESCRIPTION OF PREFERRED EMBODIMENTS

Explanations will be given on the treating conditions according to the present invention.

Before the pretreatment according to the present invention, the stainless steel sheet is subjected to an alkali degreasing treatment to remove oily dirt from the steel surface, then the stainless sheet is subjected to the precoloring treatment under the following conditions shown in Table 1.

Table 1

| Bath Composition | Concentration (g/l) | Bath Temperature (° C) Immersion | Electrolysis |
|---|---|---|---|
| Acid | 10 – 300 | | Room temperature |
| Oxidizing agent | 20 – 500 | 50 – 80 | |
| Metal salt | 5 – 200 | | |

If the concentration of the bath components and the bath temperature are below their lower limits, a longer time is required by both the immersion and the electrolytic treatment, while if they exceed their upper limits the surface of a colored stainless steel sheet becomes rough and the surface luster is deteriorates and is irregular. Regarding the acid, when hydrochloric acid is used, the surface is rough and the surface luster is deteriorated. As for the type of the treatment, both of the immersion and the electrolysis are similarly effective, but the electrolysis is advantageous because it saves the treating time.

As for the immersion time and the electrolysis time, they vary depending on the bath concentration, the bath temperature, and the steel grade to be treated, but normally the immersion time ranges from 30 seconds to 60 minutes, and the electrolysis time ranges from 5 seconds to 10 minutes. Thus, the treating time should be selected according to individual desired colors. Thus, the immersion and electrolysis time should be longer for increased contents of chromium, nickel and molybdenum in the stainless steel. In case of the electrolytic treatment, either of an anodic electrolysis or a cathodic electrolysis may be used, but the cathodic electrolysis requires a longer time.

Color tints obtained by the present invention vary depending on the acid components of the bath for the precoloring treatment. Thus, when sulfuric acid is used, increased concentration of sulfuric acid produces darker colors but decreases the surface luster, while when nitric acid or phosphoric acid is used lusterous colors can be obtained.

Meanwhile, all of the oxidizing agents and the metal salts produce almost similar coloring effects.

Figure 10:
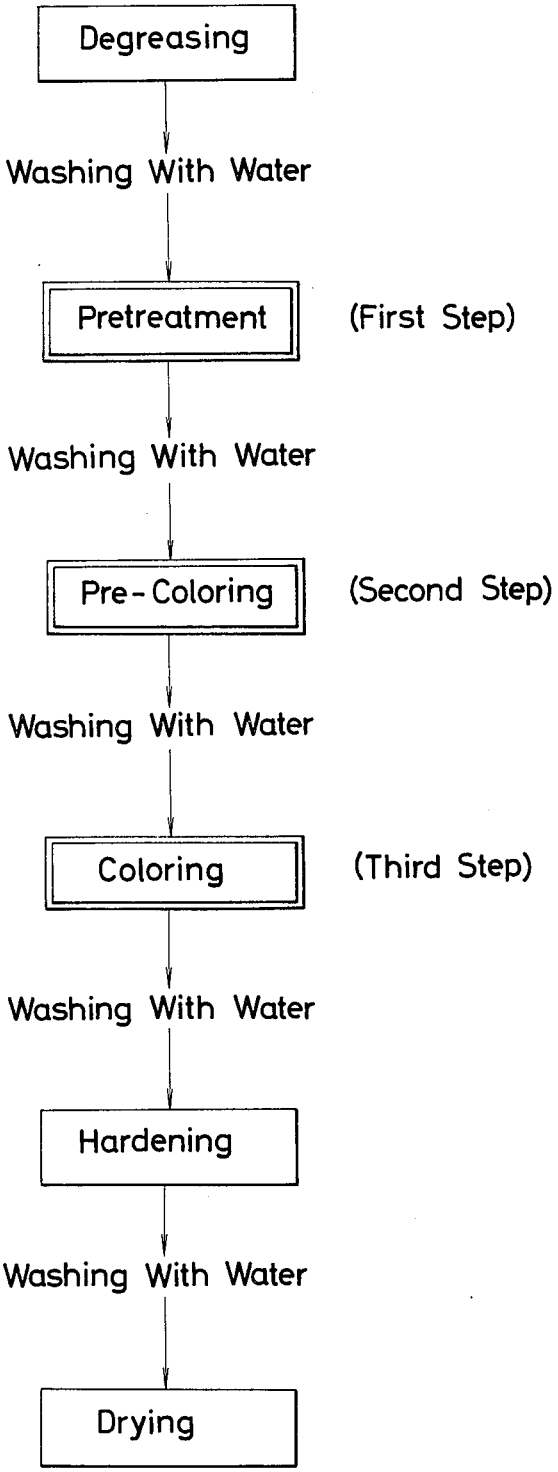
FIG. 10 is a flow-sheet of one embodiment of the present invention.

According to a preferable embodiment of the present invention as shown in FIG. 10, the surface film layer and the denaturalized layer produced on the stainless steel surface after degreasing are removed by the pretreatment (first step) so as to eliminate differences in the surface condition caused by the difference in the production history, and then, in case the of a chromium-straight stainless steels, the pretreated steel is subjected to the pre-coloring treatment (second step) in an aqueous solution containing acids together with oxidizing agents and/or metal salts so as to produce the base film, and then the steel is subjected to the coloring treatment (third step) using the potential-time curves in which the individual coloring potential difference is given by compensation of the standard coloring potential difference with inflexion point potential difference of both materials and the coloring point is controlled by the compensated potential difference, so as to obtain colors without color variation among the individual steel materials. The colored stainless steel thus obtained may be subjected to hardening treatments.

Therefore, in the case of chromium-straight stainless steels, it is most preferable to subject the steel material to the whole process of the above steps. However, satisfactory results can be obtained even by the combination of the pre-coloring treatment (second step) and the coloring treatment (third step) only, the combination of pre-coloring treatment (second step) and a conventional coloring treatment (third step) in place of the coloring treatment according to the present invention, or by the combination of the pretreatment (first step), the pre-coloring treatment (second step) and a conventional coloring treatment.

In the case of nickel-chromium stainless steels similar combinations are effective, but satisfactory results can be obtained even by the coloring treatment (third step) only.

Examples of the present invention will be set forth below.

EXAMPLE 1

In this example, BA finished or HL finished (hair line) SUS 304 and 430 stainless steels were used.

The BA finished SUS 430 stainless steel was subjected to an anodic electrolytic treatment as the precoloring treatment in a solution containing 30 g/l sulfuric acid and 200 g/l nickel sulfate at 1.0 A/dm², while the HL finished SUS 430 stainless steel was immersed in a precoloring treatment solution containing 50 g/l sulfuric acid and 50 g/l chromic acid at 70° C for 15 minutes. Then the above BA finished SUS 430 and the HL finished SUS 430 stainless steels as well as a BA finished SUS 304 and a HL finished SUS 304 stainless steels which were not subjected to the pre-coloring treatment were immersed in the coloring treatment bath containing 300 g/l chromic anhydride and 500 g/l sulfuric acid at 75° C.

The variation of the potential differences between the steel samples immersed in the bath and the platinum reference electrode was measured on a digital voltmeter and recorded continuously on a recorder. In this example, purple was intended for the BA finished SUS 304, red was intended for the HL finished SUS 304, gold for the BA finished SUS 430 and blue for the BL finished SUS 430, and the coloring was performed by calculating the individual coloring potential difference for each sample on the basis of the formula (1) according to the present invention. For comparison, SUS 304 and SUS 430 stainless steels were used. The stainless steels were not subjected to the pre-coloring treatment and were colored by a conventional method under the following condition.

Individual coloring potential difference (A′ − B′) = Standard coloring potential difference (A − B).

Table 2

| | Samples | Sample No. | Inflexion Point Potential (mV) | Coloring Potential Difference (mV) | Co-efficient | Remark |
|---|---|---|---|---|---|---|
| | | 0 | 185.54 | 14.40 | | Standard Value |
| Present Invention | SUS 304 BA finish | 1 | 186.65 | 15.07 | 0.64 | |
| | | 2 | 184.28 | 14.08 | 0.25 | |
| | | 3 | 185.90 | 14.76 | 0.55 | |
| | | 4 | 186.47 | 14.82 | 0.45 | |
| Conventional Method | SUS 304 BA finish | 5 | 183.32 | 14.40 | — | |
| | | 0 | 187.28 | 13.50 | | Standard Value |
| Present Invention | SUS 304 HL finish | 1 | 186.42 | 13.24 | 0.30 | |
| | | 2 | 178.36 | 10.38 | 0.35 | |
| | | 3 | 189.82 | 14.77 | 0.50 | |
| Conventional Method | SUS 304 HL finish | 4 | 190.02 | 13.50 | — | |
| | | 0 | 167.34 | 11.20 | | Standard Value |
| | | 1 | 168.54 | 11.74 | 0.45 | |
| Present Invention | SUS 430 HL finish | 2 | 167.50 | 11.29 | 0.55 | |
| | | 3 | 167.93 | 11.55 | 0.60 | |
| | | 4 | 166.48 | 10.94 | 0.30 | |
| Conventional Method | SUS 430 HL finish | 5 | 165.32 | 11.20 | — | |
| | | 0 | 166.82 | 8.00 | | Standard Value |
| Present Invention | SUS 430 HL finish | 1 | 165.42 | 7.58 | 0.30 | |
| | | 2 | 166.90 | 8.04 | 0.50 | |
| | | 3 | 166.23 | 7.79 | 0.35 | |
| Conventional Method | SUS 430 HL finish | 4 | 167.29 | 8.00 | — | |

Figure 5:
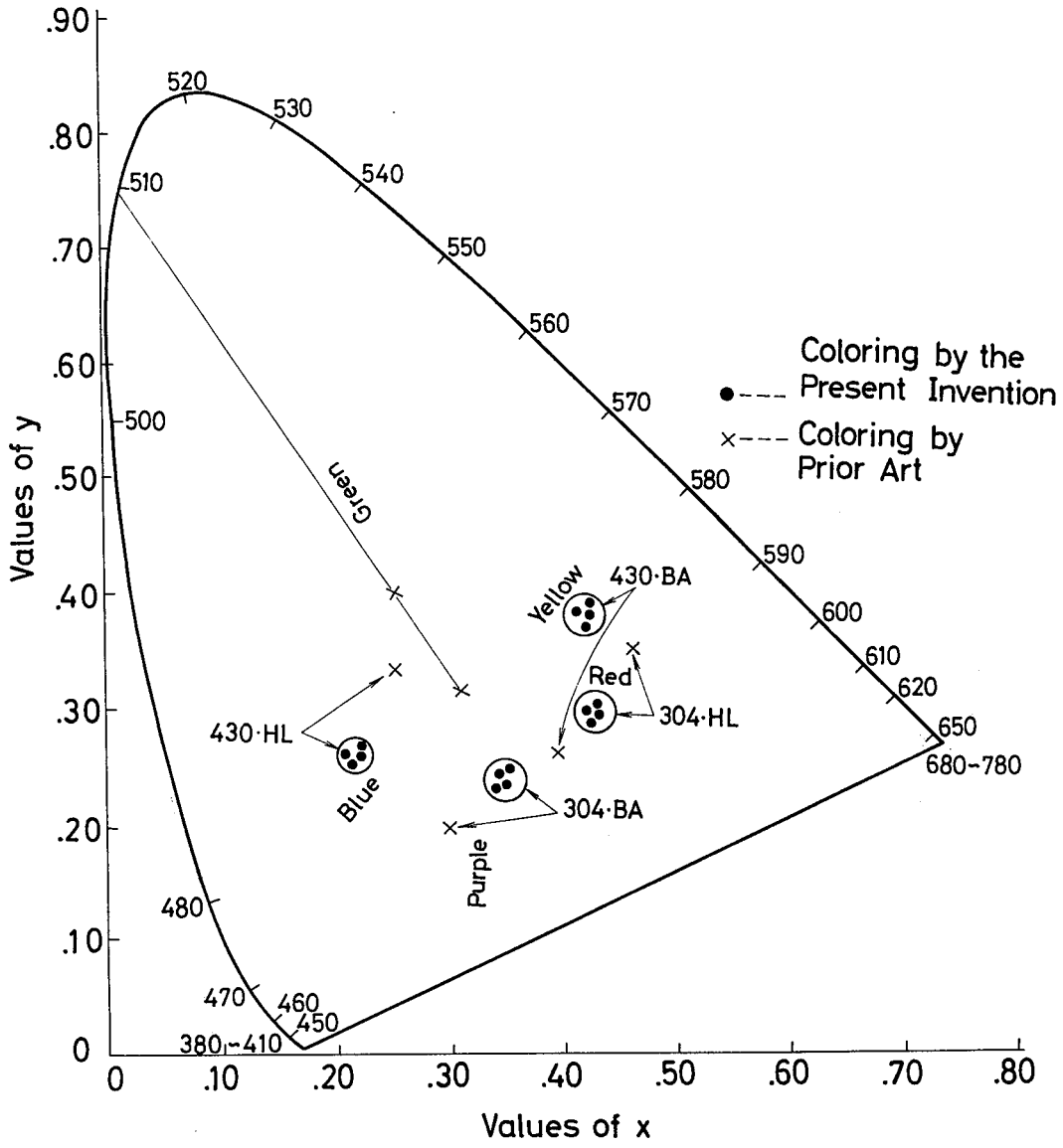
FIG. 5 is a graph showing color measurements of colored steels according to the present invention.

In Table 2, the inflexion point potential and the coloring potential difference for each sample are shown, and FIG. 5 shows results of the color measurements. It is clear from FIG. 5 that discrete colors with excellent reproductivity without color variation can be obtained by the present invention, while the colors produced by the conventional methods were completely different from those intended as shown as below.

BA finished SUS 304 — Bluish purple
HL finished SUS 304 — Reddish gold
BA finished SUS 430 — Brown
HL finished SUS 430 — Light brown.

EXAMPLE 2

Samples were taken from BA finished SUS 304 stainless steel sheets A and B of 0.6 mm thickness having different production histories, degreased, washed with water and then immersed in an aqueous solution containing 10% sulfuric acid and 10% hydrochloric acid at room temperature for 3 minutes and 10 minutes respectively. For comparison, similar samples were immersed in the same solution for 30 seconds. These samples were all washed with water, immersed in a coloring bath containing 300 g/l chromic acid, and 500 g/l sulfuric acid at 75° C under the same color control condition as in Example 1 for the purpose of obtaining blue color. Dissolved amounts of the Fe and Cr into the bath were analyzed to estimate the degree of the surface dissolution of the samples. The treating conditions, the surface dissolutions and the resulting colors are shown in Table 3.

Table 3

| | | SUS 304 BA - Immersion Treatment | | | | |
|---|---|---|---|---|---|---|
| No. | Thickness | Production History | Immersion Time | Depth of Surface Dissolution | Colors | Remark |
| 1 | | $A_1$ | 3 min | about 300Å | Discrete Blue | Present Invention |
| 2 | | $A_2$ | 10 min | about 2100Å | " | " |
| 3 | 0.6mm | $B_1$ | 3 min | about 20Å | " | " |
| 4 | | $B_2$ | 10 min | about 2000Å | " | " |
| 5 | | $A_1$ | 30 sec | about 40–50Å | Obscure Bluish White | Comparison |
| 6 | | $B_1$ | 30 sec | " | " | " |

Table 4

| No. | Thickness | SUS 304 BA - Electrolytic Treatment: Production History | Current Density | Depth of Surface Dissolution | Colors | Remark |
|---|---|---|---|---|---|---|
| 7 | | $C_1$ | 0.5A/dm² | about 450Å | Obscure Goldish White | Comparison |
| 8 | | $C_2$ | 0.8A/dm² | about 1000Å | Discrete Gold | Present Invention |
| 9 | 12mm | $D_1$ | 0.5A/dm² | about 500Å | Obscure Goldish White | Comparison |
| 10 | | $D_2$ | 0.8A/dm² | about 900Å | Discrete Gold | Present Invention |
| 11 | | $C_1$ | — | about 50–60Å | No Coloring | Conventional Method |
| 12 | | $D_1$ | — | " | " | " |

EXAMPLE 3

Samples were prepared from BA finished SUS 304 stainless steel sheets C and D of 1.2 mm thickness and having different production histories, degreased, washed with water, immersed in 10% phosphoric acid solution, and electrolyzed using the stainless steel sheet as an anode for 2.5 minutes at 0.5 A/dm² and 0.8 A/dm², respectively. For comparison with the conventional art, similar samples were immersed in 30% sulfuric acid solution at 70° C for 5 seconds until the generation of bubbles by gases.

These samples were immersed in the same coloring bath under the same condition as in Example 1 for the purpose of obtaining gold color. The surface dissolutions were determined in the same way as in Example 1. The results are shown in Table 4.

Figure 6:
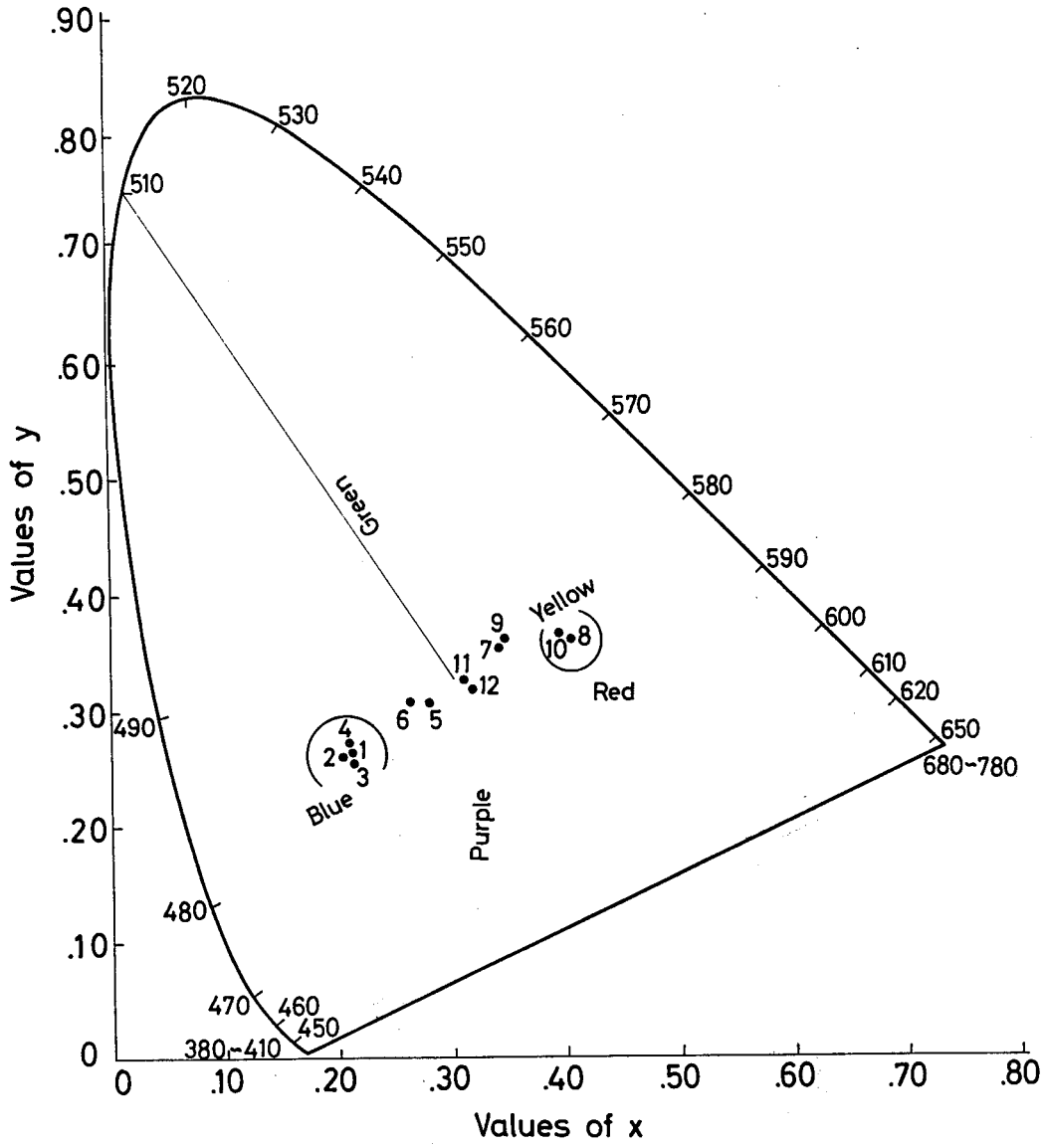
FIG. 6 is a graph showing color measurments of colored steels according to the examples of the present invention.

FIG. 6 shows results of color measurements of each samples of Examples 2 and 3 using the automatic sphere color difference meter AV-SCH-2S of TOYO RIKA KOGYO K.K. Numeral references in FIG. 6 are corresponded to the sample numbers in Tables 3 and 4.

As clearly understood from the above results, it is necessary to remove even the denaturalized layer in order to obtain colored stainless steels having discrete colors without color variation due to the difference of production history, and a desired discrete color can not be obtained by dissolution of only the surfacial film only as in the conventional method. In Examples 2 and 3, only SUS 304 stainless steel samples were used, but similar results can be obtained when SUS 430 stainless steel is treated in the same way.

EXAMPLE 4

Samples were prepared from BA finished SUS 430 and 2B finished SUS 410 and SUS 434, all being a chromium-straight stainless steel, and BA finished SUS 304, a chromium-nickel stainless steel, degreased, washed with water, and subjected to the immersion and anodic electrolytic treatments under the conditions shown in Table 5. Then the samples were washed with water and subjected to the conventional coloring treatment and the results are shown in Table 6.

In FIG. 6, the results of the conventional method were included those of samples which were not subjected to the pre-coloring treatments as shown in FIG. 5 but subjected directly to the coloring treatment.

As clearly understood from the results shown in Table 6, the method according to the present invention can produce various colors including blue, yellow, red, purple and green for both nickel-chromium stainless steels and chromium-straight stainless steels, whereas the convention method can produce only obscure brown and dark brown for chromium-straight stainless steels.

EXAMPLE 5

Figure 11:
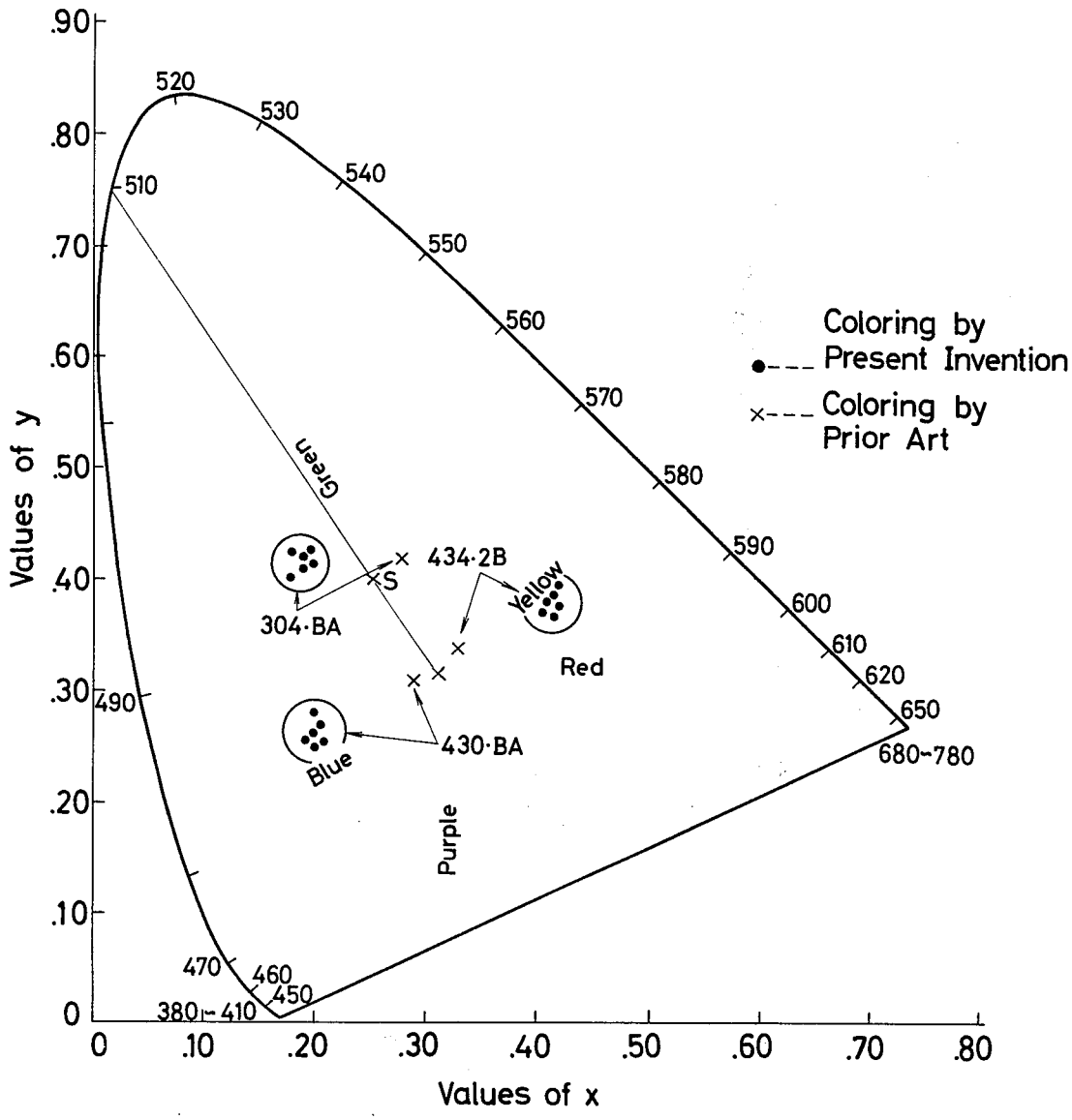
FIG. 11 is a graph showing difference between the present invention and the prior art in respect of obtained colors.

Samples were prepared from BA finished SUS 430 stainless steel and 2B finished SUS 434 sheets, both being a chromium-straight stainless steel, as well as from BA finished 304 sheet, a chromium-nickel stainless steel, degreased, washed with water, then subjected to anodic electrolysis in 10% sulfuric acid solution to dissolve the surface of the steel substrate for the purpose of eliminating the color variation due to the surface condition of the steel substrate. The samples were then subjected to the pre-coloring treatment, and to either the immersion treatment and the electrolytic treatment under the condition of No. 8 and No. 9 in Table 5, subsequently washed with water, and then subjected to the coloring treatment in the coloring bath containing 300 g/l chromic acid and 500 g/l sulfuric acid at 75° C under the same condition as in Example 1 for the purpose of obtaining blue for the BA finished SUS 430, yellow for the 2B finished SUS 434 and green for the BA finished SUS 304. The results of color measurements of these samples are shown in FIG. 11. For comparison, similar samples were treated in the same coloring bath.

It is clearly understood from the results that the chromium-straight steels, such as, SUS 430 and SUS 434, and the nickel-chromium stainless steels, such as, SUS 304 show discrete blue, yellow and green, respectively, when treated by the coloring method according to the present invention, and excellent reproductivity of individual desired colors can be assured by the present invention, whereas the BA finished SUS 430 colored by the conventional method shows bluish brown and the 2B finished SUS 434 shows light brown and the BA finished SUS 304 shows obscure yellowish green, and the desired colors are not obtained by the conventional method.

Table 5

| Designation | Sample No. | Pre-Coloring Treatment (Second Step) Pre-Coloring Solution (g/l) Acid $H_2SO_4$ | Acid $HNO_3$ | Oxidizng Agent $H_3PO_4$ | Oxidizng Agent $CrO_3$ | Oxidizng Agent $K_2Cr_2O_7$ | Oxidizng Agent $Na_2Cr_2O_7$ | Metal Salt $MnSO_4$ | Metal Salt $NiSO_4$ | Metal Salt $Ni(NO_3)_2$ | Metal Salt $FeSO_4$ |
|---|---|---|---|---|---|---|---|---|---|---|---|
| Present Invention | 1 | 30 | | | | | | | 200 | | |
| | 2 | | 50 | | 50 | | | | | | |
| | 3 | | | 100 | | 300 | | 5 | | | |
| | 4 | | 50 | | | | | | | | 5 |
| | 5 | 100 | 100 | | | | 500 | | | | |
| | 6 | 50 | 100 | 150 | 350 | | | | | | |
| | 7 | 100 | | | 100 | 50 | | 20 | | | 10 |
| | 8 | | 100 | | 150 | 150 | 200 | | | 20 | |
| | 9 | 100 | | | 250 | | | 50 | 40 | | 10 |
| | 10 | 100 | | | 40 | 10 | | 3 | | | 2 |
| | 11 | 10 | | | 20 | | | | | | |
| Conventional Method | 12 | | | | | | | | | | |
| | 13 | | | No Pre-Coloring Treatment | | | | | | | |
| | 14 | | | | | | | | | | |

| Sample No. | Treating Method Immersion | Treating Method Electrolysis | Temperature (° C) | Current Density (A/dm²) | Treating Time (min.) SUS 410 2B | SUS 434 2B | SUS 430 BA | SUS 304 BA |
|---|---|---|---|---|---|---|---|---|
| 1 | | ○ | 23 | 1.0 | 3 | | 3 | 3 |
| 2 | ○ | | 70 | — | 12 | | 15 | |
| 3 | ○ | | 70 | — | 14 | | 16 | |
| 4 | | ○ | 23 | 1.0 | | | 3 | |
| 5 | ○ | | 70 | — | 8 | | 13 | 15 |
| 6 | | ○ | 23 | 2.0 | | 2 | 2 | 3 |
| 7 | ○ | | 70 | — | 10 | | 15 | 20 |
| 8 | | ○ | 23 | 3.0 | 2 | | 2 | 3 |
| 9 | ○ | | 70 | — | 10 | 17 | 15 | |
| 10 | ○ | | 70 | — | | 17 | 16 | |
| 11 | | ○ | 45 | 2.0 | 4 | | 5 | 7 |
| 12 | | | | | | | | |
| 13 | | No Pre-Coloring Treatment | | | | | | |
| 14 | | | | | | | | |

Table 6

| Designation | Sample No. | Coloring Treatment: Coloring Solution (g/l) $CrO_3$ | Coloring Solution (g/l) $H_2SO_4$ | Temperature (° C) | Immersion Time (min.) SUS 410 2B | SUS 434 2B | SUS 430 BA | SUS 304 BA | Colors SUS 410 2B | SUS 434 2B | SUS 430 BA | SUS 304 BA |
|---|---|---|---|---|---|---|---|---|---|---|---|---|
| Present Invention | 1 | 500 | 300 | 75 | 3 | | 7 | 5 | Blue | | Red | Gold |
| | 2 | " | " | " | 9 | | 5 | | Green | | Gold | |
| | 3 | " | " | " | 7 | | 8 | | Red | | Purple | |
| | 4 | " | " | " | | | 3 | | | | Blue | |
| | 5 | " | " | " | 5 | | 5 | 7 | Blue | | Gold | Red |
| | 6 | " | " | " | | 3 | 9 | 3 | | Blue | Green | Blue |
| | 7 | " | " | " | 8 | | 3 | 8 | Purple | | Blue | Purple |
| | 8 | " | " | " | 5 | | 7 | 9 | Gold | | Red | Green |
| | 9 | " | " | " | 3 | 3 | 3 | | Blue | Blue | Blue | |
| | 10 | " | " | " | 1 | 5 | 7 | | | Gold | Red | |
| | 11 | " | " | " | 7 | | 5 | 5 | Red | | Gold | Gold |
| Conventional Method | 12 | 500 | 300 | 75 | 5 | 10 | 10 | 10 | Brown | Brown | Brown | Blue |
| | 13 | " | " | " | 10 | 5 | 20 | 19 | Brown | Brown | Dark Brown | Red |
| | 14 | 300 | 100 | " | 20 | 20 | 5 | 20 | Brown | Brown | Brown | Blue |

What is claimed is:

1. In a method for coloring a stainless steel wherein the stainless steel is immersed in a coloring bath for a period of time, the improvement which comprises:

a. determining for a given sample of said steel in the bath the difference between the standard inflexion point potential and the potential present when the sample has the desired color, the potentials being determined against a reference electrode immersed in the bath;

b. determining the individual inflexion point potential for a sample of the steel to be colored; and c. immersing the steel to be colored in the bath for a period of time such that the coloring process is stopped when the potential difference between the individual inflexion point potential and the instantaneous potential is determined by the formula:

Potential difference

= potential difference for the standard sample when the sample has the desired color
± α (Standard inflexion point potential — individual inflexion point potential)

wherein α is + when a saturated calomel electrode is used and is - when a platinum electrode is used; and wherein α is between 0.23 to 0.36 when the individual inflexion point potential is nobler than the standard inflexion point and is between 0.44 and 0.61 when the individual inflexion point potential is base compared to the standard inflexion point potential.

2. A method according to any of claim 1, which further comprises removing a surfacial film layer and a denaturalized layer formed on the surface of the stainless steel prior to the coloring.

3. A method according to claim 2, in which an acid solution containing at least one acid selected from the group consisting of sulfuric acid, phosphoric acid, nitric acid, chromic acid and hydrochloric acid is used for removing the surfacial film layer and the denaturalized layer.

4. A method according to claim 3, in which the stainless steel is immersed in the acid solution.

5. A method according to claim 4, in which the immersion is done for 30 to 1200 seconds at a temperature between 40° and 60° C.

6. A method according to claim 3, in which the stainless steel is electrolized in the acid solution.

7. A method according to claim 6, in which the electrolysis is done at a current density between 0.5 and 30 $A/dm^2$.

8. A method according to any of claim 1, in which the stainless steel is subjected to a pre-coloring treatment in an aqueous solution containing at least one acid selected from the group consisting of sulfuric acid, nitric acid, phosphoric acid, and at least one compound selected from the group consisting of chromic anhydride, potassium dichromate, sodium dichromate and iron salts, nickel salts and manganese salts.

9. A method according to claim 8, in which the pre-coloring treatment is done by immersion in the aqueous solution.

10. A method according to claim 9, in which the immersion is done for 30 seconds to 60 minutes.

11. A method according to claim 8, in which the precoloring treatment is done by electrolysis in the aqueous solution.

12. A method according to claim 11, in which the electrolysis is done for 5 seconds to 10 minutes.

13. A method of claim 1 which further comprises subjecting the stainless steel to a precoloring treatment in an aqueous solution containing at least one acid selected from the group consisting of sulfuric acid, nitric acid, phosphoric acid, chromic anhydride, potassium dichromate, sodium dichromate and iron salts, nickel salts and manganese salts, in an amount from 10 to 20 g/l for sulfuric nitric and phosphoric acids, respectively, in an amount from 20 to 500 g/l for chromic anhydride, potassium dichromate and sodium dichromate, respectively, and in an amount from 5 to 200 g/l for iron, nickel and manganese salts, respectively.

14. A method according to claim 13, in which the pre-coloring treatment is done by immersion in the aqueous solution.

15. A method according to claim 13, in which the pre-coloring treatment is done by electrolysis in the aqueous solution.

* * * * *